United States Patent [19]

McClaflin

[11] 4,246,920

[45] Jan. 27, 1981

[54] METHOD OF TRANSPORTING VISCOUS HYDROCARBONS

[75] Inventor: Gifford G. McClaflin, Ponca City, Okla.

[73] Assignee: Conoco, Inc., Ponca City, Okla.

[21] Appl. No.: 13,867

[22] Filed: Feb. 22, 1979

Related U.S. Application Data

[63] Continuation-in-part of Ser. No. 918,015, Jun. 22, 1978, abandoned.

[51] Int. Cl.[3] ..... F17D 1/17

[52] U.S. Cl. ..... 137/13; 252/8.55 R; 252/312

[58] Field of Search ..... 252/312, 352, 8.3, 8.55 R, 252/8.55 D; 137/13; 302/66; 406/48, 49

[56] References Cited

U.S. PATENT DOCUMENTS

| | | | |
|---|---|---|---|
| 2,447,475 | 8/1948 | Kaberg et al. | 252/312 |
| 2,533,878 | 12/1950 | Clark et al. | 137/13 |
| 3,006,354 | 10/1961 | Sommer et al. | 137/13 |
| 3,023,700 | 3/1962 | Dever et al. | 137/13 |
| 3,361,213 | 1/1968 | Savins | 169/1 |
| 3,380,531 | 4/1968 | McAuliffe et al. | 166/314 |
| 3,425,429 | 2/1969 | Kane | 137/13 |
| 3,467,195 | 9/1969 | McAuliffe et al. | 166/314 |
| 3,491,385 | 1/1970 | Gagle | 137/13 X |
| 3,572,354 | 3/1971 | Tinsley et al. | 137/13 |
| 3,811,505 | 5/1974 | Flournoy et al. | 252/8.55 X |
| 3,943,954 | 3/1976 | Flournoy et al. | 137/13 |
| 4,108,193 | 8/1978 | Flournoy et al. | 137/13 |

*Primary Examiner*—Herbert B. Guynn

*Attorney, Agent, or Firm*—Bayless E. Rutherford, Jr.

[57] ABSTRACT

An improvement in the method of transporting viscous hydrocarbons through pipes is disclosed. Briefly, the improvement comprises adding water, certain specific surfactants and a basic material to the hydrocarbon. The resulting emulsion has a much lower viscosity and is more easily transported.

10 Claims, No Drawings

METHOD OF TRANSPORTING VISCOUS HYDROCARBONS

CROSS-REFERENCE TO RELATED APPLICATIONS

The present application is a continuation-in-part of application Ser. No. 918,015, filed June 22, 1978 now abandoned.

Application Ser. No. 13,358, filed Feb. 21, 1979, and having the same assignee as the present application, discloses and claims an improvement in the method of transporting viscous hydrocarbons through pipes wherein the improvement comprises adding water containing an effective amount of a low molecular weight alkaryl sulfonate.

BACKGROUND OF THE INVENTION

1. Field of the Invention

The invention is in the general field of improved methods of pumping viscous hydrocarbons through a pipe, such as a well-bore or a pipeline.

2. General Background

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that is is expensive and the kerosine distillate is becoming difficult to obtain.

Another method of improving the movement of these heavy crudes is by heating them. This requires the installation of expensive heating equipment and thus is an expensive process.

The use of oil-in-water emulsions, which use surfactants to form the emulsion is known in the art.

I have found that the use of a small amount of a basic compound (e.g. NaOH) in conjunction with certain specific surfactants provides an improvement. The use of the basic compound reduces the amount of surfactant required and thereby reduces the cost. Furthermore, the use of the basic compound enables the use of such a small amount of surfactant that refining problems are reduced or eliminated.

BRIEF SUMMARY OF THE INVENTION

Briefly stated, the present invention is directed to an improvement in the method of pumping a viscous hydrocarbon through a pipe wherein the improvement comprises forming an oil-in-water emulsion by adding to said hydrocarbon from about 20 to about 80 volume percent water, containing minor but effective amounts of the combination of (a) an alkali metal or ammonium hydroxide and (b) certain specific surfactants which are selected from the group consisting of water-soluble alkylbenzene sulfonates and an ethoxylated phenol nonionic.

DETAILED DESCRIPTION

Insofar as is known my method is suitable for use with any viscous crude oil.

The amount of water which is used is suitably in the range of about 20 to about 80 volume percent based on the hydrocarbon. A preferred amount of water is in the range of about 40 to 60 volume percent. The water can be pure or can have a relatively high amount of dissolved solids. Any water normally found in the proximity of a producing oil-well is suitable.

Suitable basic compounds for addition to the water include the hydroxides of sodium, potassium and ammonium. Sodium hydroxide is preferred by reason of cost and availability. The amount of basic compound present in the water suitably is in the range of about 400 to about 10,000 parts per million (ppm) by weight. Preferably, the amount of basic compound is in the range of about 600 to about 1250 parts per million by weight.

Two types of surfactants are suitable for use in my invention. The first type is a sodium or potassium salt of an alkylbenzene sulfonate containing about 8 to about 14 carbon atoms in the alkyl group or groups. The benzene can be either monoalkyl- or dialkyl-substituted, but preferably is monoalkyl. The alkyl group or groups can be linear or branched chain. The preferred surfactant, in this type, is a sodium monoalkylbenzene sulfonate wherein the alkyl group contains about 11 to about 13 carbon atoms.

The second type of surfactant comprises two specific nonionics. First, an ethoxylated mono- or dialkyl phenol, wherein each alkyl group contains from about 8 to about 12 carbon atoms, said ethoxylated alkyl phenol containing from about 20 to about 100 ethoxy groups, preferably from about 30 to about 70 ethoxy groups. Second, in some cases the ethoxylated phenol can be in combination with a polyethylene glycol, said polyethylene glycol having a molecular weight in the range of about 1,000 to about 3,000, preferably about 1800 to about 2200. When the glycol is present typically the combination contains a phenol to glycol weight ratio of about 4:1.

A suitable amount of surfactant is in the range of about 10 to about 500 parts by million by weight, preferably about 50 to about 100 parts per million (ppm) by weight.

In order to illustrate the nature of the present invention still more clearly the following examples will be given. It is to be understood, however, that the invention is not to be limited to the specific conditions or details set forth in these examples except insofar as such limitations are specified in the appended claims.

The following materials were used in the tests described herein:

Crude Oil—Goodwin lease crude from Cat Canyon oil field, Santa Maria, California Water—Goodwin synthetic (Water prepared in laboratory to simulate water produced at the well. It contained 4720 ppm total solids.)

Sodium Hydroxide—C.P. grade, pellet form

Surfactants

A—sodium monoalkylbenzene sulfonate having a molecular weight of approximately 334

B—A nonionic as described in the foregoing.

The nonionic will be identified more specifically in the examples.

Viscosities were determined using a Brookfield viscometer, Model LV with No. 3 spindle. The procedure is described below.

Test Procedure

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60. Viscosity was calculated by using a multiplication factor of 200, 100, 40 and 20 for the respective speeds times the dial reading on the viscometer.

It may be well to mention that the final result at 6 RPM is an indication of the stability of the solution being tested.

EXAMPLE 1

This example shows the viscosity values obtained on the crude alone and the crude containing 50 volume percent water which contains 5,000 ppm Surfactant "A".

The results are shown in Table 1.

TABLE 1

| | CRUDE ALONE | | CRUDE 50 VOL % IN WATER CONTAINING 5,000 PPM SURF. "A" | |
|---|---|---|---|---|
| RPM | Dial Reading | Viscosity cp | Dial Reading | Viscosity cp |
| 6 | 21 | 4,200 | 0.5 | 100 |
| 12 | 40 | 4,000 | 2.0 | 200 |
| 30 | 94 | 3,766 | 3.0 | 120 |
| 60 | Offscale | — | 3.6 | 72 |
| 30 | 87 | 3,480 | 3.0 | 120 |
| 12 | 34 | 3,400 | 2.0 | 200 |
| 6 | 15.8 | 3,160 | 1.5 | 300 |
| Test Temperature 82° C. | | | Test Temperature 49° C. | |

EXAMPLE 2

Example 1 was repeated except that the amount of Surfactant "A" was 1250 ppm.

The results are shown in Table 2.

TABLE 2

| | CRUDE ALONE | | CRUDE 50 VOL % IN WATER CONTAINING 1,250 PPM SURF. "A" | |
|---|---|---|---|---|
| RPM | Dial Reading | Viscosity CP | Dial Reading | Viscosity CP |
| 6 | 15.5 | 3,100 | 4 | 800 |
| 12 | 29 | 2,900 | 5.5 | 550 |
| 30 | 62 | 2,480 | 8 | 320 |
| 60 | 69 | 1,380 | 11.8 | 236 |
| 30 | 61 | 2,440 | 7 | 280 |
| 12 | 25 | 2,500 | 4 | 400 |
| 6 | 11.5 | 2,300 | 3.2 | 640 |
| Test Temperature 96° C. | | | Test Temperature 77° C. | |

EXAMPLE 3

This example shows the results obtained using 1250 ppm NaOH in water.

The results are shown in Table 3.

TABLE 3

| | CRUDE ALONE | | CRUDE 50 VOL % IN WATER CONTAINING 1,250 PPM NaOH | |
|---|---|---|---|---|
| RPM | Dial Reading | Viscosity CP | Dial Reading | Viscosity CP |
| 6 | 20 | 4,000 | 1 | 200 |
| 12 | 36 | 3,600 | 1.5 | 150 |
| 30 | 84 | 3,360 | 2.5 | 60 |
| 60 | Off scale | — | 4.3 | 86 |
| 30 | 81 | 3,240 | 2.5 | 100 |
| 12 | 33 | 3,300 | 2 | 200 |
| 6 | 17 | 3,400 | 1 | 200 |
| Test Temperature 82° C. | | | Test Temperature 67° C. | |

EXAMPLE 4

This example illustrates the improvement obtained using my invention.

Example 2 was repeated except that the amount of Surfactant "A" was 50 ppm and the aqueous solution contained 625 ppm NaOH.

The results are shown in Table 4.

TABLE 4

| | CRUDE ALONE | | CRUDE 50 VOL % IN WATER CONTAINING 50 PPM SURF. "A" AND 625 PPM SODIUM HYDROXIDE | |
|---|---|---|---|---|
| RPM | Dial Reading | Viscosity CP | Dial Reading | Viscosity CP |
| 6 | 21 | 4,200 | 0.25 | 50 |
| 12 | 39 | 3,900 | 1 | 100 |
| 30 | 94 | 3,760 | 2 | 80 |
| 60 | Off scale | — | 2 | 40 |
| 30 | 90 | 3,600 | 1 | 40 |
| 12 | 35 | 3,500 | 1 | 100 |
| 6 | 17 | 3,400 | .25 | 50 |
| Test Temperature 71° C. | | | Test Temperature 66° C. | |

EXAMPLE 5

This example used a different sample of Cat Canyon crude. The example illustrates the results obtained using equal amounts of surfactant and NaOH.

The procedure was the same as in Example 2. Viscosity values were obtained on crude oil alone and on crude oil plus an equal amount of water (300 ml each), wherein the water contained 500 ppm Surfactant "A".

The results are shown in Table 5.

TABLE 5

| | CRUDE OIL ALONE (300 ML) | | CRUDE OIL PLUS 300 ML WATER CONTAINING 500 PPM SURF. "A" AND 500 PPM SODIUM HYDROXIDE | |
|---|---|---|---|---|
| RPM | Dial Reading | Viscosity CP | Dial Reading | Viscosity CP |
| 6 | 48 | 9,600 | 1.5 | 300 |
| 12 | 91.5 | 9,150 | 2.5 | 250 |
| 30 | Off scale | — | 4 | 160 |
| 60 | Off scale | — | 6.5 | 130 |
| 30 | Off scale | — | 4 | 160 |
| 12 | 91 | 9,100 | 2.3 | 230 |
| 6 | 46 | 9,200 | 1.5 | 300 |
| Test Temperature 82° C. | | | Test Temperature 68° C. | |

EXAMPLE 6

This example illustrates the results obtained using 625 ppm NaOH in water.

The results are shown in Table 6.

TABLE 6

| | CRUDE ALONE | | CRUDE 50 VOL % IN WATER CONTAINING 625 PPM NaOH | |
|---|---|---|---|---|
| RPM | Dial Reading | Viscosity cp | Dial Reading | Viscosity cp |
| 6 | 26 | 5,200 | 1 | 200 |
| 12 | 50 | 5,000 | 1.5 | 150 |
| 30 | Offscale | — | 3 | 120 |
| 60 | Offscale | — | 7 | 140 |
| 30 | Offscale | — | 8.5 | 340 |
| 12 | 52 | 5,200 | 7 | 700 |
| 6 | 26 | 5,200 | 6 | 1200 |
| Test Temperature 82° C. | | | Test Temperature 71° C. | |

EXAMPLE 7

This example illustrates the results obtained using a 125 ppm of a nonionic in water. The nonionic was a combination of an ethoxylated alkyl phenol, containing 50 moles of ethylene oxide per mole of alkyl phenol, and a polyethylene glycol wherein the ethoxylated phenol to polyethylene glycol weight ratio was 4:1. The polyethylene glycol had a molecular weight in the range of about 1,000 to about 3,000.

The results are shown in Table 7.

TABLE 7

| | CRUDE ALONE | | CRUDE 50 VOL % IN WATER containing 125 PPM NONIONIC SURF. | |
|---|---|---|---|---|
| RPM | Dial Reading | Viscosity CP | Dial Reading | Viscosity CP |
| 6 | 19 | 3,800 | 52.3 | 10,460 |
| 12 | 35.7 | 3,570 | 93 | 9,300 |
| 30 | 84.3 | 3,372 | Off scale | — |
| 60 | Off scale | — | Off scale | — |
| 30 | 81 | 3,240 | Off scale | — |
| 12 | 32 | 3,200 | 95 | 9,500 |
| 6 | 16 | 3,200 | 48 | 9,600 |
| Test Temperature 82° C. | | | Test Temperature 79° C. | |

EXAMPLE 8

This example illustrates the results obtained using a combination of 625 ppm NaOH and 100 ppm of the nonionic surfactant used in Example 7.

The results are shown in Table 8.

TABLE 8

| | CRUDE ALONE | | CRUDE 50 VOL % IN WATER CONTAINING 625 PPM NaOH AND 100 PPM NONIONIC | |
|---|---|---|---|---|
| RPM | Dial Reading | Viscosity CP | Dial Reading | Viscosity CP |
| 6 | 30 | 6,000 | 1 | 200 |
| 12 | 55 | 5,500 | 1 | 100 |
| 30 | Off scale | — | 1 | 40 |
| 60 | Off scale | — | 2 | 40 |
| 30 | Off scale | — | 3 | 120 |
| 12 | 57 | 5,700 | 3 | 300 |
| 6 | 31 | 6,200 | 3 | 600 |
| Test Temperature 82° C. | | | Test Temperature 71° C. | |

EXAMPLE 9

This example illustrates the results obtained using a combination of 1250 ppm NaOH and 50 ppm of the nonionic surfactant used in Example 8.

The results are shown in Table 9.

TABLE 9

| | CRUDE ALONE | | CRUDE 50 VOL % IN WATER CONTAINING 1250 PPM NaOH AND 50 PPM NONIONIC | |
|---|---|---|---|---|
| RPM | Dial Reading | Viscosity CP | Dial Reading | Viscosity CP |
| 6 | 23 | 4,600 | 0.5 | 100 |
| 12 | 41.5 | 4,150 | 1 | 100 |
| 30 | 99 | 3,960 | 1.5 | 60 |
| 60 | Off scale | — | 3 | 60 |
| 30 | 98 | 3,920 | 1.5 | 60 |
| 12 | 39 | 3,900 | 1 | 100 |
| 6 | 18.5 | 3,700 | 0.5 | 100 |
| Test Temperature 88° C. | | | Test Temperature 66° C. | |

EXAMPLE 10

This example illustrates the results obtained using a combination of 700 ppm NaOH and 100 ppm of a different nonionic surfactant than used in Examples 7–9. The nonionic was an ethoxylated octyl phenol containing 70 moles of ethylene oxide per mole of octyl phenol.

The results are shown in Table 10.

TABLE 10

| | CRUDE ALONE | | CRUDE 50 VOL % IN WATER CONTAINING 700 PPM NaOH AND 100 PPM NONIONIC | |
|---|---|---|---|---|
| RPM | Dial Reading | Viscosity CP | Dial Reading | Viscosity CP |
| 6 | 15.5 | 3,100 | 1.5 | 300 |
| 12 | 31 | 3,100 | 2.5 | 250 |
| 30 | 77 | 3,080 | 3.5 | 140 |
| 60 | Off scale | — | 7 | 140 |
| 30 | 77 | 3,080 | 3 | 120 |
| 12 | 31 | 3,100 | 1.5 | 150 |
| 6 | 11.5 | 2,300 | 1.5 | 300 |
| Test Temperature 93° C. | | | Test Temperature 74° C. | |

Thus, having described the invention in detail, it will be understood by those skilled in the art that certain variations and modifications may be made without departing from the spirit and scope of the invention as defined herein and in the appended claims.

I claim:

1. In the method of pumping a viscous hydrocarbon through a pipe the improvement which comprises forming an oil-in-water emulsion by adding to said hydrocarbon from about 20 to about 80 volume percent of an aqueous solution, based on said hydrocarbon, containing about 400 to 10,000 parts per million alkali metal or ammonium hydroxide and about 10 to about 500 parts per million of a surfactant selected from the group consisting of:

(a) water-soluble alkylbenzene sulfonates wherein the alkyl group or groups contain about 8 to about 14 carbon atoms, and (b) the combination of an ethoxylated mono- or dialkyl phenol, wherein the alkyl groups contain from about 8 to about 12 carbon atoms and said phenol contains from about 20 to about 100 ethoxy groups and a polyethylene glycol said combination having a phenol to glycol weight ratio of about 4:1, said polyethylene glycol having a molecular weight in the range of about 1,000 to about 3,000.

2. The improved method of claim 1 wherein the surfactant is a water-soluble alkylbenzene sulfonate wherein the alkyl groups contain about 8 to about 14 carbon atoms.

3. The improved method of claim 2 wherein the surfactant is a sodium monoalkylbenzene sulfonate wherein the alkyl group contains about 11 to about 13 carbon atoms.

4. The improved method of claim 1 wherein the surfactant is a combination of an ethoxylated mono- or dialkyl phenol, wherein the alkyl group contains from about 8 to about 12 carbon atoms, and wherein from about 20 to about 100 ethoxy groups are present, and a polyethylene glycol, said combination having a phenol to glycol weight ratio of about 4:1.

5. The improved method of claim 1 wherein (a) the amount of aqueous solution added to said hydrocarbon is from about 40 to about 60 weight percent and (b) the alkali metal or ammonium hydroxide is sodium hydroxide.

6. The improved method of claim 5 wherein the surfactant is a water-soluble alkylbenzene sulfonate wherein the alkyl groups contain about 8 to about 14 carbon atoms.

7. The improved method of claim 6 wherein the surfactant is a sodium monoalkylbenzene sulfonate wherein the alkyl group contains about 11 to about 13 carbon atoms.

8. The improved method of claim 5 wherein the surfactant is a combination of an ethoxylated mono- or dialkyl phenol, wherein the alkyl group contains from about 8 to about 12 carbon atoms, and wherein from about 20 to about 100 ethoxy groups are present, and a polyethylene glycol, said combination having a phenol to glycol weight ratio of about 4:1.

9. The improved method of claim 7 wherein the amount of sodium hydroxide is about 600 to about 1250 parts per million and the amount of surfactant is about 50 to about 100 parts per million.

10. The improved method of claim 8 wherein the amount of sodium hydroxide is about 600 to about 1250 parts per million and the amount of surfactant is about 50 to about 100 parts per million.

* * * * *